US006015190A

United States Patent [19]

Wend

[11] Patent Number: 6,015,190

[45] Date of Patent: Jan. 18, 2000

[54] FOLDING HUNTING SEAT

[76] Inventor: Charles Albert Wend, 1292 Northbend Rd., Hebron, Ky. 41048

[21] Appl. No.: 09/190,510

[22] Filed: Nov. 12, 1998

[51] Int. Cl.[7] ..... A47C 4/00; A47D 1/02

[52] U.S. Cl. ..... 297/378.1; 297/16.1; 297/17; 297/183.5; 297/344.12; 297/183.1; 297/16.2

[58] Field of Search ..... 297/378.1, 16.1, 297/16.2, 17, 183.5, 252, 344.12, 344.18, 183.1

[56] References Cited

U.S. PATENT DOCUMENTS

| | | | |
|---|---|---|---|
| D. 167,514 | 8/1952 | Hicks | D15/11 |
| D. 251,333 | 3/1979 | Thrift et al. | D3/45 |
| D. 279,947 | 8/1985 | Ballarini | D6/501 |
| D. 296,393 | 6/1988 | Tuzi | D6/336 |
| D. 312,004 | 11/1990 | Smith et al. | D6/368 |
| D. 313,894 | 1/1991 | Tiramani | D6/336 |
| D. 316,190 | 4/1991 | Sadan | D6/335 |
| D. 330,639 | 11/1992 | Munro et al. | D6/335 |
| D. 333,737 | 3/1993 | Adams | D6/368 |
| D. 339,695 | 9/1993 | Kahl et al. | D6/370 |
| D. 350,238 | 9/1994 | Ward | D6/335 |
| D. 352,612 | 11/1994 | Pond et al. | D6/356 |
| D. 355,779 | 2/1995 | Tribelsky | D6/368 |
| D. 360,768 | 8/1995 | Hwang et al. | D6/368 |
| D. 367,367 | 2/1996 | Bekerman | D6/336 |
| D. 373,475 | 9/1996 | Sullivan | D6/335 |
| 2,570,842 | 9/1951 | O'Connor . | |
| 4,079,992 | 3/1978 | Thrift et al. | 297/17 X |
| 4,601,364 | 7/1986 | York | 182/187 |
| 4,674,631 | 6/1987 | Williams | 297/118 X |
| 4,746,166 | 5/1988 | Sadan | 297/17 |
| 4,871,209 | 10/1989 | Handelman | 297/378.1 |
| 5,018,788 | 5/1991 | Cedergreen | 297/378.1 |
| 5,042,875 | 8/1991 | Biggs, Jr. | 297/252 |
| 5,094,505 | 3/1992 | Nichols | 297/378.1 X |
| 5,190,344 | 3/1993 | Anderson et al. | 297/17 |
| 5,335,377 | 8/1994 | Masyada et al. | 4/578.1 |
| 5,460,426 | 10/1995 | Tribelsky et al. | 297/17 |
| 5,511,849 | 4/1996 | Cahaley et al. | 297/183.5 X |
| 5,524,915 | 6/1996 | Liu | 297/17 X |
| 5,536,068 | 7/1996 | Valentor et al. | 297/344.18 |
| 5,658,047 | 8/1997 | Ratza et al. | 297/378.1 X |
| 5,820,221 | 10/1998 | Greaves et al. | 297/378.14 |

*Primary Examiner*—Peter M. Cuomo
*Assistant Examiner*—Rodney B. White
*Attorney, Agent, or Firm*—Wood, Herron & Evans, L.L.P.

[57] ABSTRACT

A portable, foldable chair having a seat back and a seat bottom, is provided, especially appropriate for hunting and similar outdoor uses. The seat bottom has a relieved area toward the rearward area that forms a handle. Flanking this relieved area are two apertures that accept curved brackets extending from the seat back. The brackets pivot within the apertures with pivot stops abutting both the front and back of these apertures when the seat back is in its upright position. When folded, the seat back nests within the seat bottom. Also provided are independently extendable front legs to accommodate uneven terrain, reinforcing seat bottom and seat back ribs, provisions for carrying the seat over the shoulder, vents for draining rainwater or dissipating heat, and use of camouflage colors.

22 Claims, 3 Drawing Sheets

FOLDING HUNTING SEAT

BACKGROUND OF THE INVENTION

This invention relates to a portable, foldable chair, especially suited to outdoor activities like hunting.

Hunters tend to walk for extended periods in terrain unsuitable for sitting, such as over ground that is rough, wet or frozen. In addition, the ground can be sloped or uneven. Some hunting situations require the hunter to wait in a tree stand above prey. In other situations, the hunter needs to sit close to the ground, obscured by ground cover. Moreover, the hunter tends not to hunt in improved areas readily accessible to vehicles.

Some known foldable seats are generally configured for use on a prepared surface. For example, stadium bench seats can be of cold metal without back support so folding seats are provided that will grip to the bench seat. These stadium folding chairs are entirely unsuitable for hunting and hiking because they do rely on gripping to the bench seat to prevent falling over backward. Also, the provisions for carrying assume a modest distance. The weight and provisions for carrying would be unsuitable for other outdoor uses.

Some chairs are of lightweight plastic construction but are unsuitably bulky. Many single piece chair designs exist for home and backyard use. Although weather resistant and relatively light, the lack of a foldable backrest and the extension of the legs makes them an impediment in carrying. Moreover, a hunter may prefer sitting as close as practical to ground level for safety reason and to minimize being seen by prey, nor do these chairs have provisions for securing to a tree stand or backpack.

Other chairs, such as those common for seaside use, are foldable, weather resistant and short-legged. However, these chairs also suffer from having to resort to metal frames to achieve sufficient strength at the fold mechanism. And, these designs tend to still be bulky and unsuitable for extended portage.

Since these chairs are not designed with hunting in mind, they do not have additional features of interest to hunters such as appropriate colors to avoid alerting prey, ability to dissipate heat or collected water, and ability to hand carry the chair with one hand.

SUMMARY OF THE INVENTION

The present invention meets these and other needs. A foldable chair is provided with a seat back that nests with a seat bottom in a compact fashion with a folding mechanism formed of brackets extending from the seat back pivoting about a pivot axis within apertures in the seat bottom, utilizing pivot stop surfaces on the brackets against abutting stop surfaces in the apertures. The strength inherent in the folding mechanism allows lightweight, economic monolithic construction. The chair also has an integral carrying handle.

Consistent with one aspect of the invention, a foldable chair is provided with a seat bottom having a seat bottom contoured surface with a rearward area including an aperture with a forward abutting stop surface and a radially opposed aft abutting stop surface. The chair also includes a seat back having a seat back contoured surface. The seat back has at least one bracket extending from the seat back and pivotally received within the aperture, the brackets being pivotally related to the seat bottom for rotation of the seat back about a pivot axis between an upright position and a folded position. When the seat back, with its bracket projecting through the aperture and being substantially wholly received within the interior of the seat bottom, is rotated into upright position, radially opposed pivot stop surfaces on the bracket contact the respective radially opposed abutting stop surfaces. Consequently, the need for a pivot pin is either eliminated or load-bearing requirements on any pivot mechanism are reduced.

Consistent with another aspect of the invention, a foldable chair is provided that includes a seat bottom having a seat bottom contoured surface having a rearward area, the rearward area having a handle formed by a generally upwardly opening elongate slot, the rearward area having a pair of apertures flanking the elongate slot, each one of the pair of apertures defining an abutting stop. The foldable chair has a seat back with a seat back (backrest) contoured surface and a pair of parallel brackets, each of which extends from the seat back and is received within one of the apertures. Each bracket is pivotally connected to the seat bottom for rotation about a pivot axis, the pivot axis laterally bisecting the rearward area and the pair of apertures. Thus, the seat back pivots between an upright position and a folded position, the brackets projecting through the apertures and being substantially wholly received within the interior of the seat bottom when the seat back is rotated into an upright position. Each bracket has pivot stops which contact the abutting stops respectively when the seat back is rotated into the upright position. More specifically, the abutting stop includes an aft abutting stop surface at the rearward face of the aperture and a forward abutting stop surface at the forward face of the aperture. Each pivot stop includes a forward pivot stop surface and an aft pivot stop surface, the aft pivot stop surface presented above the pivot axis and to the rear of the bracket when the seat back is in the upright position, the forward pivot stop surface extended in an arc from the pivot axis curving from the generally vertical direction to the generally forward direction contacting the forward abutting stop surface when the seat back is in the upright position. Thus, when the seat back is in its deployed or upright position, and loaded, the rearward forces are resisted by the radially arranged abutting stop and pivot stop surfaces. The pivot itself bears minimal structural loads. This provides both strong support when the seat is in the upright position and facilitates snapfit installation of the seat back with the pivot projection snapping into the cooperating recess when the seat bottom component and seat back component are assembled.

The chair provides additional features such as being close to the ground so that hunters can take advantage of ground cover. Independently extendable legs accommodate sloped or uneven terrain. The chair is configured for straps so that the chair can be carried over the shoulder to a hunting site or blind. Provisions are made to color the chair appropriately for hunting situations. Appropriate strength without sacrificing portability is achieved with integral reinforcing seat bottom and seat back ribs. Furthermore, a preferred construction from plastic provides water resistence and insulating characteristics.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
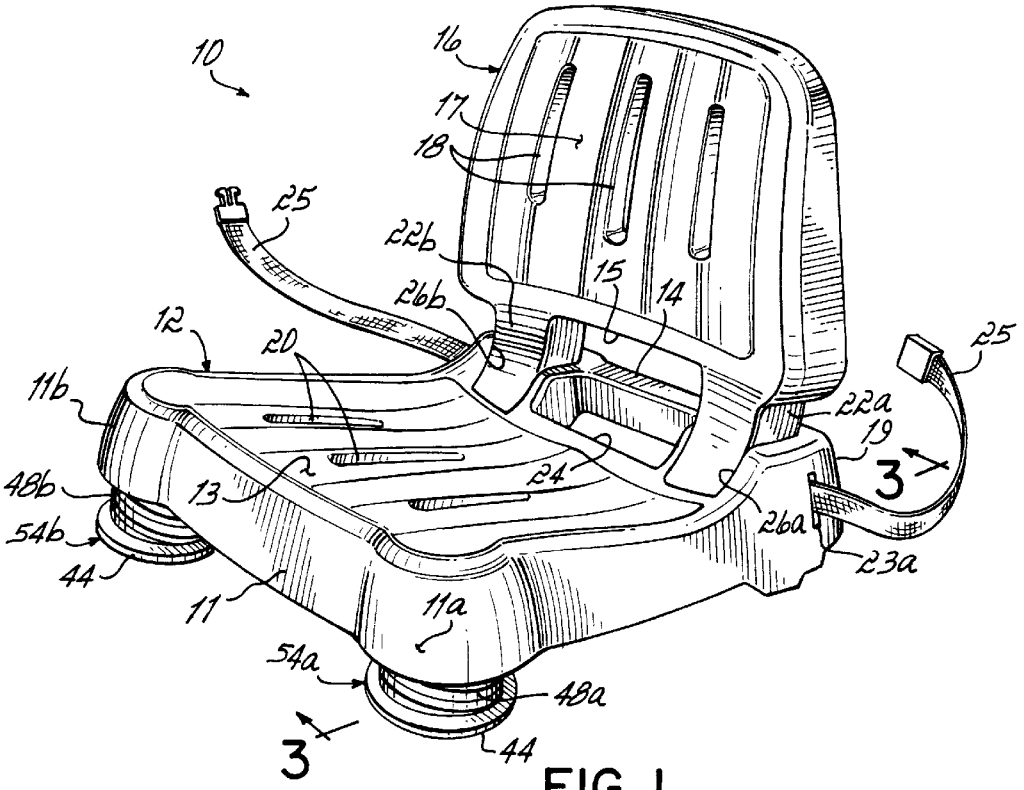
FIG. 1 is a front perspective view of the illustrative embodiment consistent the invention in its unfolded condition.

Referring to FIG. 1, a foldable chair 10, consistent with the invention, is shown in its unfolded, or "in use", condition. The chair 10 is bilaterally symmetric left to right. Features specific to the left or right are denoted with an "a" and "b" respectively with those laterally common having no further designation to its number. Description of elements on one side are applicable to the other.

The chair 10 has a seat bottom 12 with a forward area 11 having a left forward corner 11*a* and a right forward corner 11*b*, a rearward area 19, and a seat bottom contoured surface 13. The comers of the rearward area 19 have apertures 26*a* and 26*b* within an interior 27 of the seat bottom 12. Between these apertures 26*a* and 26*b* is a lower relieved area 24 in the shape of an elongated slot centered from the upper face of the rearward area 19 to the lower aft facing portion of the rearward area 19. This relieved area 24 defines a handle 14. The seat bottom contoured surface 13 has lower vent slots 20 for allowing water or heat to dissipate downward. The seat back 16, shown in its upright position in FIGS. 1 & 3, has brackets 22*a* & 22*b* extending in an arc downwardly. The apertures 26*a* & 26*b* pivotally receive respectively the brackets 22*a* & 22*b*. The seat back 16 has a seat back contoured surface 17 that is provided with upper vent slots 18.

The seat bottom 12 is further provided with strap slots 23*a* & 23*b* retaining a strap 25, allowing the chair 10 to be secured to a backpack or carried. The strap 25 could also be used to secure the seat back 16 to the seat bottom 12 in the folded condition. It is anticipated that additional slots could be incorporated to provide for additional straps and that the slots could be positioned in other locations on the chair 10, including the seat back 16.

Figure 2:
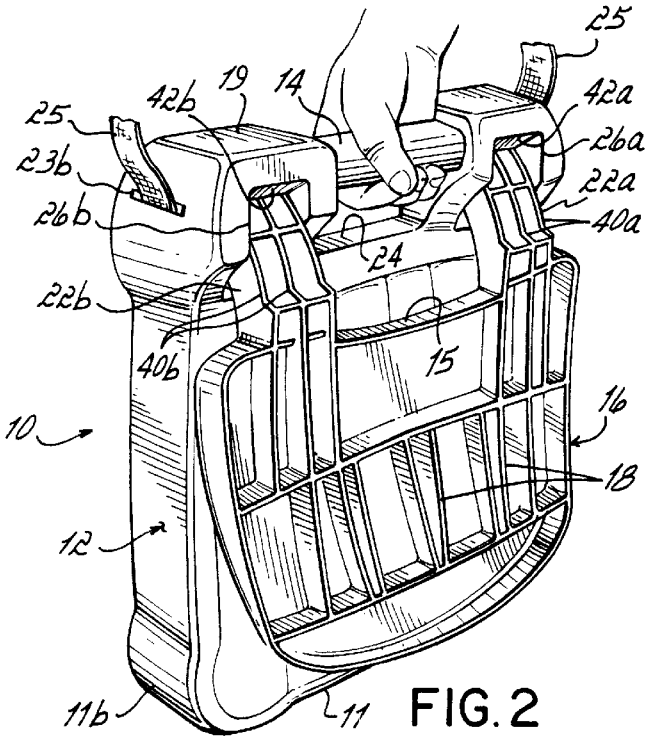
FIG. 2 illustrates the embodiment of FIG. 1 in its folded condition and shown being hand carried with seat back ribs exposed.

Referring to FIG. 2, the chair 10 is shown in its folded position with its rearward area 19 disposed above its forward area 11 since the chair 10 is being carried by the handle 14. The seat back contoured surface 17, when the seat back 16 is folded, generally conforms, or nests, or becomes adjacent with the seat bottom contoured surface 13. The brackets 22*a* and 22*b* extending away from the seat back 16 create an upper relieved area 15 that cooperates with the lower relieved area 24 allowing the handle 14 to be gripped when the chair 10.

The preferred material for the chair 10 is molded thermoset or thermoplastic polymers ("plastic"). Use of plastic provides resistence to water, has insulating The preferred material for the chair 10 is molded thermoset or thermoplastic polymers ("plastic"). Use of plastic provides resistence to water, has insulating properties, provides flexibility required to assemble the two principal members, the seat back 16 to the seat bottom 12, as described below, and allows economical unitary fabrication of the two principal members. The plastic can have colored added before molding or be painted, especially in earth tones and foliage colors ("camouflage colors") suitable for use in hunting. Moreover, a camouflage pattern can readily be achieved by injecting a combination of colored liquid plastics into the mold or selectively painting the chair 10 in a plurality of camouflage colors.

Referring to FIG. 2, the seat back 16 is shown having a plurality of reinforcing seat back ribs 30. Alternatively, the seat back contoured surface 17 could be of a thickness such that the seat back ribs 30 would not be required.

Figure 3:
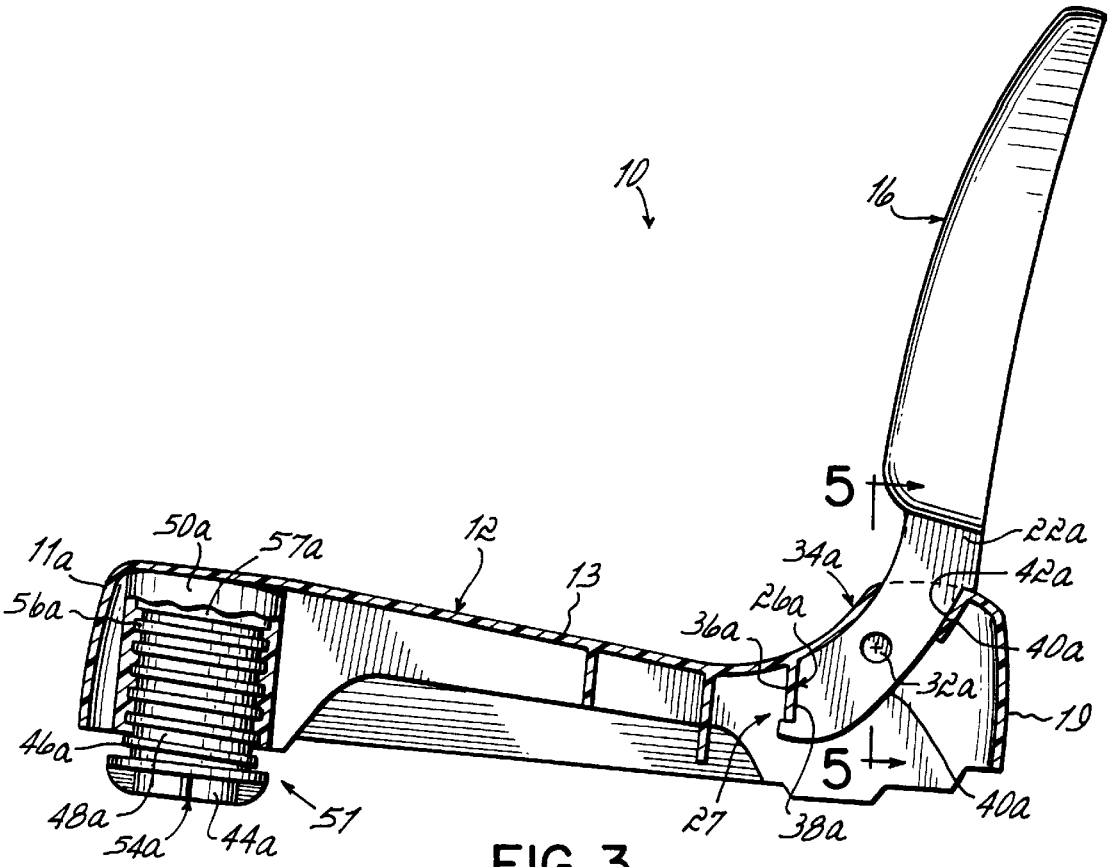
FIG. 3 is a cross-sectional view taken on line 3—3 of the embodiment of FIG. 1 showing a folding mechanism in the unfolded condition and showing a leg member in a partially extended condition.

Referring to FIG. 3, the chair 10 is shown with the left side in cross section, emphasizing a folding mechanism 34*a* formed by the cooperation of the bracket 22*a* pivoting in an arc about a pivot pin 32*a* in aperture 26*a*. The pivot pin 32*a* defines a pivot axis about which the seat back 16 rotates. The seat back 16 is held in its upright position by having a forward pivot stop surface 36*a* and an aft pivot stop surface 40*a* on the bracket 22*a* contact a forward abutting stop surface 38*a* and an aft abutting surface 42*a*, respectively, within the aperture 26*a*. The forward abutting stop surface 38*a* is generally forward of the pivot pin 32*a* and the aft abutting stop surface 42*a* is generally in a vertical direction of the pivot pin 32*a*. Thus, the folding mechanism 34*a* acts in a fashion to minimize loads transferred to the pivot pin 32*a* when the seat back 16 is in its upright position by having the forward abutting stop surface 38*a*, 38*b* in radial opposition to the aft abutting stop surfaces 42*a*, 42*b*, respectively. When the seat back is upright, this hinge with its two-point abutment, makes this product very mechanically safe and durable.

FIG. 3 also shows a leg member 54*a* including a leg sleeve 50*a* that has a first end proximate an underside 51 of to the forward area 11 of the seat bottom 12. The leg sleeve 50*a* has a cylindrical cavity 57*a* opening at its bottom at a second end opening generally below the first end. Inside the cavity 57*a* is internal female threads 56*a*. The leg member 54*a* further includes a leg extender 48*a* with an upper portion generally cylindrical in shape for being threadably received within the cavity 56*a*. For that purpose, the leg extender 48*a* has external male threads 46*a* that cooperate with the internal female threads 56*a* of the leg sleeve 50*a*. The leg extender 48*a* terminates in a foot 44*a* that prevents the leg extender 48*a* from being threaded too deeply into the leg sleeve 50*a*, the foot 44*a* engages the ground during use, and the foot 44*a* provides a grip for threading the leg extender 48*a*.

Figure 4:
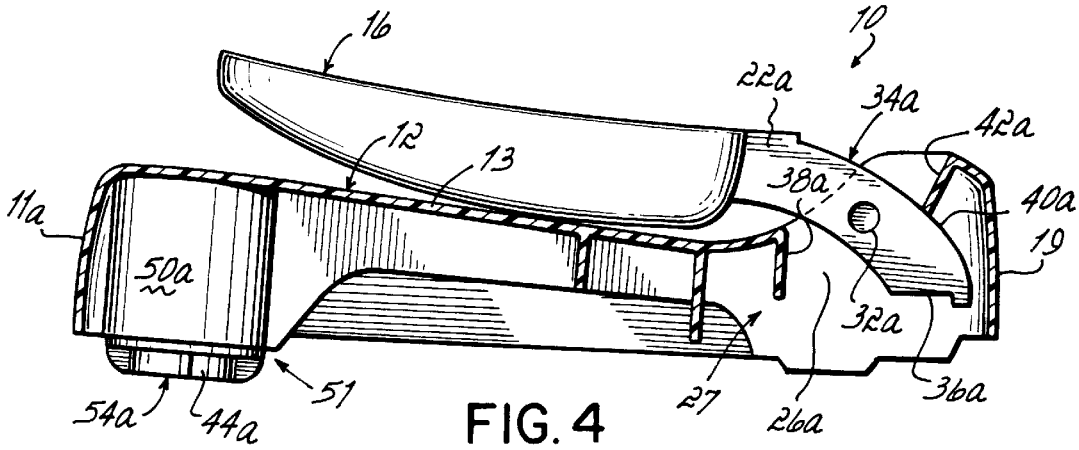
FIG. 4 is a cross-sectional view similar to FIG. 3 showing the folding mechanism in the folded condition and showing the leg member in its fully retracted condition.

Referring to FIG. 4, the chair 10 is shown again in its folded condition shown in cross section to emphasize the folding mechanism 34*a* in the folded condition and to shown the leg member 54*a* in its retracted condition.

The seat back contoured surface 17 is shown generally conforming, or nesting, to the seat bottom contoured surface 13. The rotation to the folded position is also arrested by the bracket 22*a* perpendicularly contacting the aft abutting stop 42*a*.

Figure 5:
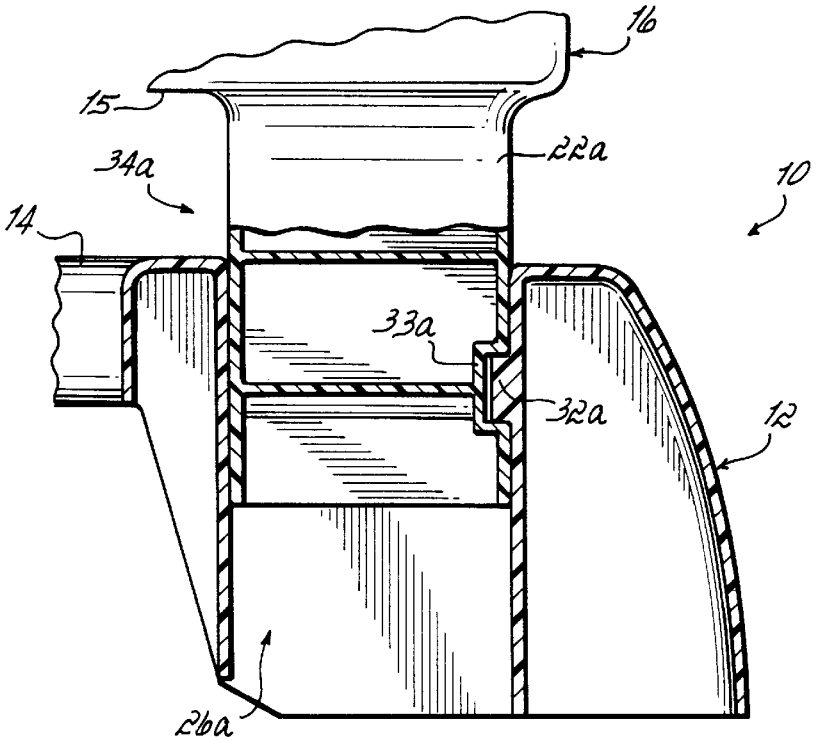
FIG. 5 is a cross-sectional view taken on line 5—5 of FIG. 3, showing a preferred attachment of a seat bottom to a seat back.

FIG. 5 shows a cross sectional view taken through the pivot axis line 5—5 of FIG. 3. In the preferred embodiment, the pivot pin 32*a* comprises having the inward face of aperture 26*a* include an integral pivot boss 32*a*' received by a pivot recess 33*a*' on the outward face of the bracket 22*a*. The flexible plastic used in the construction of the chair 10 allows the insertion of the brackets 22*a* & 22*b* into the apertures for this engagement.

Figure 6:
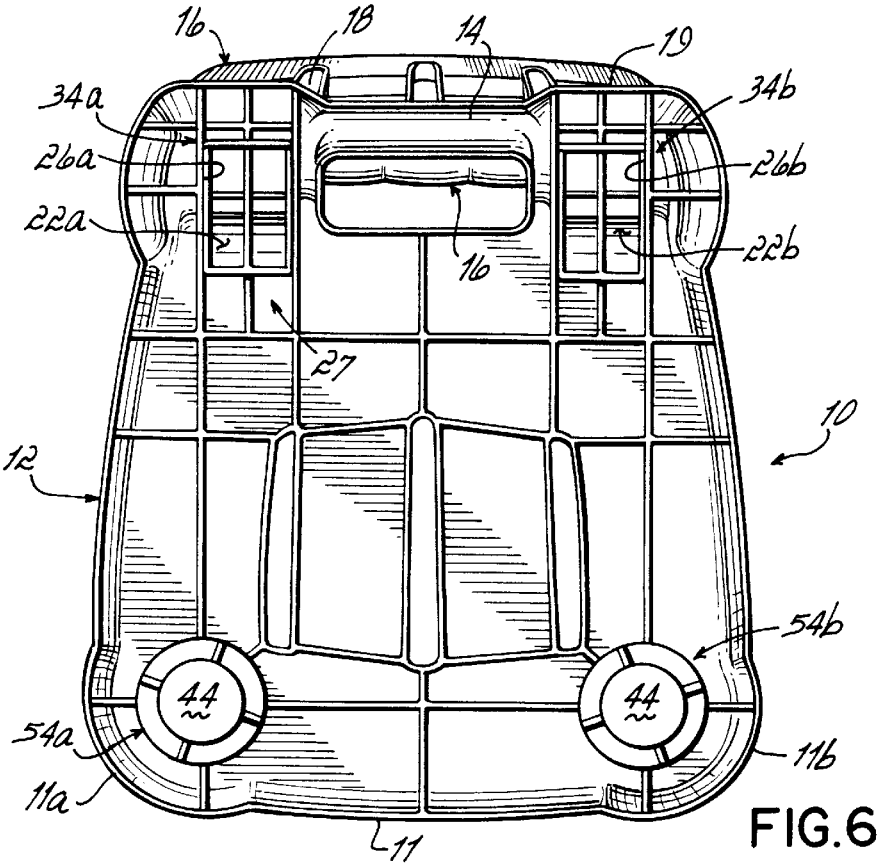
FIG. 6 is a bottom view of the embodiment of FIG. 1 showing the bottom of the seat member with its reinforcing seat bottom ribs.

Referring to FIG. 6, the bottom view of the seat bottom 12 provides a plurality of reinforcing seat bottom ribs 59. Alternatively, the seat bottom contoured surface 13 could be of a thickness such that the seat bottom ribs 59 would not be required.

From the foregoing, it will be appreciated that the invention contemplates a rugged, safe, yet light weight hunting seat adaptable for numerous uses and primarily for stable placement on the ground so the user is in a safe, non-elevated and relatively hidden position. The seat is totally self-supporting and sturdy while offering portability in movement.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A foldable chair, comprising:

a seat bottom having a seat bottom contoured surface having an interior and a rearward area, the rearward area having a handle formed by a generally upwardly opening elongate slot, the rearward area having a pair of apertures flanking the elongate slot, each of the pair of apertures defining abutting stops including an aft abutting stop surface at a rearward face of the aperture and a forward abutting stop surface at a forward face of the aperture; and a seat back having a seat back contoured surface, the seat back having a pair of brackets, each of which extends from the seat back and is received within one of the apertures, the brackets being pivotally connected to the seat bottom for rotation about a pivot axis, the pivot axis laterally bisecting the rearward area and the pair of apertures, the seat back being pivotable between an upright position and a folded position, the brackets projecting through the apertures and being substantially received within the interior of the seat bottom when the seat back is rotated into upright position, the brackets having pivot stops including a forward pivot stop surface and an aft pivot stop surface that contact respectively the forward abutting stop surface and aft abutting stop surface when the seat back is rotated into the upright position.

2. The foldable chair of claim 1, wherein the seat bottom includes a plurality of leg members extending generally downward from the seat bottom for supporting the chair, each leg member having a leg sleeve attached to an underside of the seat bottom, each leg member having a leg extension adjustably attachable to the leg sleeve.

3. The foldable chair of claim 2, wherein the seat bottom includes two forward corners, and wherein the plurality of leg members comprises a right leg member and a left leg member, each at one of the two forward corners of the seat bottom, the right and left leg members cooperating to recline the chair.

4. The foldable chair of claim 2, wherein each leg sleeve has a first end and a second end, the first end positioned proximate to the seat bottom, the leg sleeve having a cylindrical cavity opening in a generally downward direction at the second end, each leg extension threadably received within the cylindrical cavity.

5. The foldable chair of claim 1, wherein the seat back contoured surface nests within the seat bottom contoured surface when the seat back is in the folded position.

6. The foldable chair of claim 5, wherein the chair is molded plastic, the seat bottom further comprises lower reinforcing ribs.

7. The foldable chair of claim 5, wherein the chair includes slots for receiving a strap.

8. The foldable chair of claim 7, wherein the strap is a shoulder strap.

9. The foldable chair of claim 5, wherein the seat back includes a seat back contoured surface and the seat bottom includes a seat bottom contoured surface, and wherein the seat back includes a seat back vent slot opening into the seat back contoured surface and the seat bottom includes a seat bottom vent slot opening into the seat bottom contoured surface.

10. A foldable chair, comprising:

a seat bottom having a seat bottom contoured surface having an interior and a rearward area including an aperture, the aperture including a pair of radially opposed abutting stop surfaces; and a seat back having a seat back contoured surface, the seat back having at least one bracket extending from the seat back and received within the aperture, the bracket being pivotally connected to the seat bottom for rotation about a pivot axis, the pivot axis laterally bisecting the rearward area and the aperture, the seat back being pivotable between an upright position and a folded position, the bracket projecting through the aperture and being received within the interior of the seat bottom when the seat back is rotated into the upright position, the bracket having a pair of radially opposed pivot stop surfaces that contact the pair of radially opposed abutting stop surfaces respectively when the seat back is rotated into the upright position.

11. The foldable chair of claim 10, wherein the seat bottom includes a plurality of leg members extending generally downward from the seat bottom for supporting the chair, each leg member having a leg sleeve attached to an underside of the seat bottom, each leg member having a leg extension adjustably attachable to the leg sleeve.

12. The foldable chair of claim 11, wherein the seat bottom includes two forward corners, and wherein the plurality of leg members comprises a right leg member and a left leg member, each at one of the two forward corners of the seat bottom, the right and left leg members cooperating to recline the chair.

13. The foldable chair of claim 11, wherein each leg sleeve has a first end and a second end, the first end positioned proximate to the seat bottom, the leg sleeve having a cylindrical cavity opening in a generally downward direction at the second end, each leg extension threadable received within the cylindrical cavity.

14. The foldable chair of claim 10, wherein the seat back contoured surface nests within the seat bottom contoured surface when the seat back is in the folded position.

15. The foldable chair of claim 14, wherein the chair comprises molded plastic, the seat bottom further comprises lower reinforcing ribs.

16. The foldable chair of claim 14, wherein the chair includes slots for receiving a strap.

17. The foldable chair of claim 16, wherein the strap is a shoulder strap.

18. The foldable chair of claim 14, wherein the seat back includes a seat back vent slot opening into the seat back contoured surface and the seat bottom includes a seat bottom vent slot opening into the seat bottom contoured surface.

19. The foldable chair of claim 10, wherein the seat back includes a plurality of brackets and the seat bottom includes a plurality of apertures in the rearward area receiving the plurality of brackets.

20. The foldable chair of claim 19, wherein the rearward area includes a handle formed by a generally upwardly opening elongate slot, the elongate slot flanked by the plurality of apertures.

21. The foldable chair of claim 10, wherein the pair of radially opposed abutting stop surfaces of the apertures cooperate respectively with the pair of radially opposed pivot stop surfaces of the bracket to substantially cancel a load at the pivot axis.

22. The foldable chair of claim 10, further including a pivot pin pivotably coupling the bracket and the aperture.

* * * * *